United States Patent [19]

Fredin et al.

[11] 4,200,943

[45] May 6, 1980

[54] AUTOMOBILE TOOL

[76] Inventors: Ell C. Fredin, 402 SE. "D" Ave., Gilmore City, Iowa 50541; James W. Morgan, 1412 Elmhurst Ave., Humboldt, Iowa 50548; Milo H. Waimer, Arnolds Parks, Iowa 51331

[21] Appl. No.: 955,939

[22] Filed: Oct. 30, 1978

[51] Int. Cl.[2] ..... B25F 1/00

[52] U.S. Cl. ..... 7/100; 7/170

[58] Field of Search ..... 7/100, 167, 170; 15/105, 236 R

[56] References Cited

U.S. PATENT DOCUMENTS

| | | | |
|---|---|---|---|
| 2,860,858 | 11/1958 | Kurs | 15/236 R X |
| 3,427,636 | 2/1969 | Seifert | 15/236 R X |
| 3,504,388 | 4/1970 | Tunstall et al. | 7/170 X |

*Primary Examiner*—James G. Smith

*Attorney, Agent, or Firm*—Zarley, McKee, Thomte, Voorhees & Sease

[57] ABSTRACT

An automobile tool device is disclosed comprising an elongated support element having a beveled edge forward end adapted for removing ice and a jam element attached to the rearward end with the jam element having a plurality of stepped surfaces to engage the operating lever of a gasoline pump handle and hold the lever in an operating position. A second jam element is detachably secured to the support element and is adapted to maintain a spring biased license plate in a position away from the body of an automobile.

6 Claims, 3 Drawing Figures

AUTOMOBILE TOOL

BACKGROUND OF THE INVENTION

This invention relates to automobile tools and more particularly to an automobile tool that can be utilized to maintain a gasoline pump in an unattended operating mode, hold a spring bias license plate in a position away from the automobile body to allow access to the gasoline filler tube, and to remove ice from a windshield. In many self-service gasoline stations, the customer is required to manually operate the gasoline pump during the time period required to fill the tank. No prior automobile tools allow the customer to set and maintain the actuating lever of a gasoline pump handle in a predetermined position so that the pump will operate unattended.

SUMMARY OF THE INVENTION

An automobile tool device is disclosed comprising an elongated support element having a forward end with a beveled edge adapted for removing ice from a windshield and an upstanding plate element having a lower edge attached to the rearward end of the support element and having an upper edge comprised of a plurality of stepped surfaces adapted to engage the operating lever of a gasoline pump handle. The stepped surfaces are spaced apart from the support element such that the flow rate of gasoline as determined by the operating lever is selectively adjustable by means of engagement with a particular surface. The support element also comprises a surface area to support and maintain an automobile gas cap. The jam element is adapted to maintain a spring biased automobile license plate in a position away from the automobile body and is detachably secured to the plate element by a pressure adhesive. The jam element is length adjustable in order to adapt to a variety of automobile body styles.

It is a principal object of this invention to provide an improved automobile tool device.

A still further object of this invention is to provide an automobile tool to maintain a gasoline pump in an operating condition by jamming the operating lever of the gasoline pump handle in a predetermined position.

A still further object of the invention is to provide an automobile tool device that comprises a plurality of stepped surfaces to engage the operating lever of a gasoline pump handle.

A still further object of the invention is to provide an automobile tool device that can also be utilized for scraping ice from a windshield.

A still further object of the invention is to provide an automobile tool device that holds a spring biased license plate in a position away from the body of an automobile to allow easy access to the gas filler pipe.

A still further object of the invention is to provide an automobile tool device that is economical to manufacture, durable in use and refined in appearance.

DESCRIPTION OF THE PREFERRED EMBODIMENT

Figure 1:
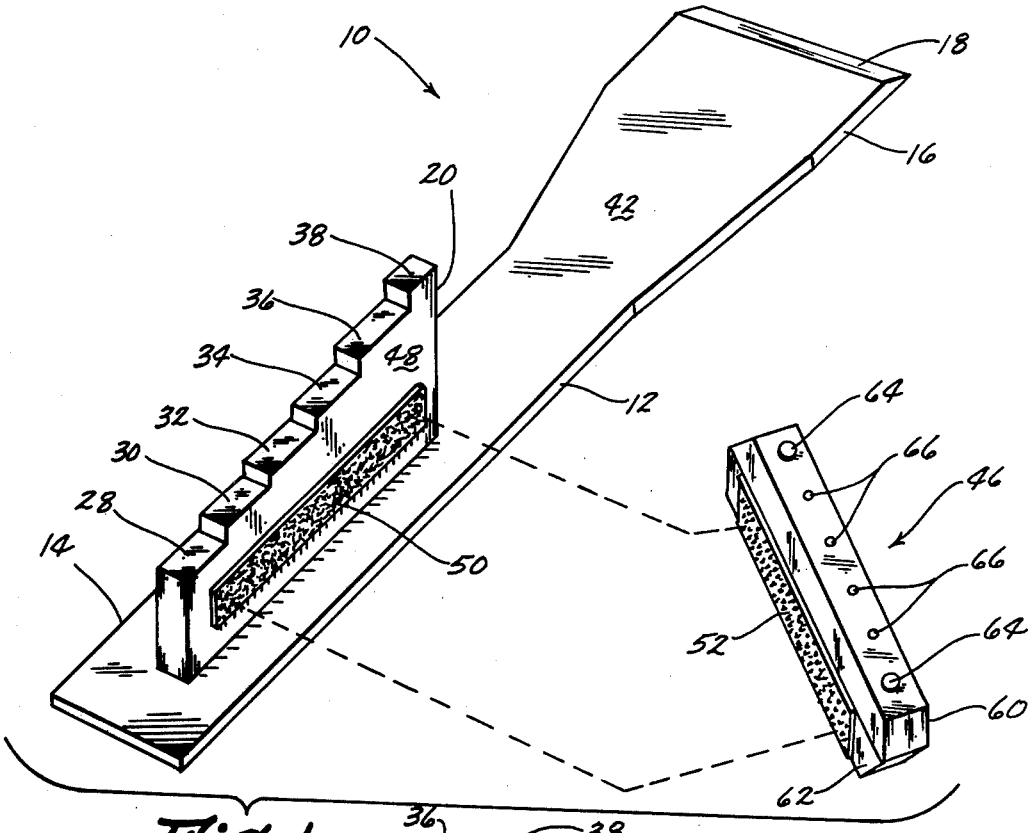
FIG. 1 is a partially exploded perspective view of this invention.
Figure 2:
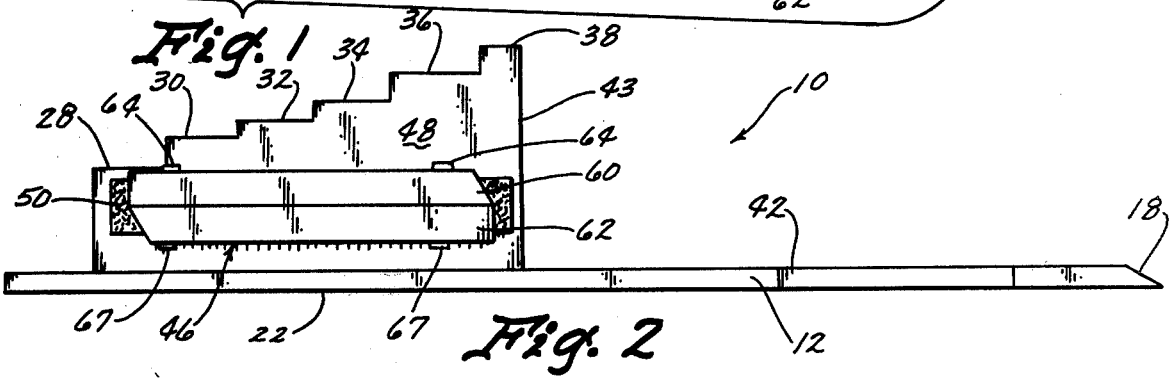
FIG. 2 is an elevated side view of the present invention.

The numeral 10 generally refers to the automobile tool device of this invention shown in FIG. 1.

Tool device 10 comprises an elongated support element having an elongated rear portion 14 and a forward portion 16 with a beveled forward edge 18. The beveled forward edge 18 facilitates the removal of snow and ice from an automobile windshield when the tool device 10 is utilized as an ice scraper.

Figure 3:
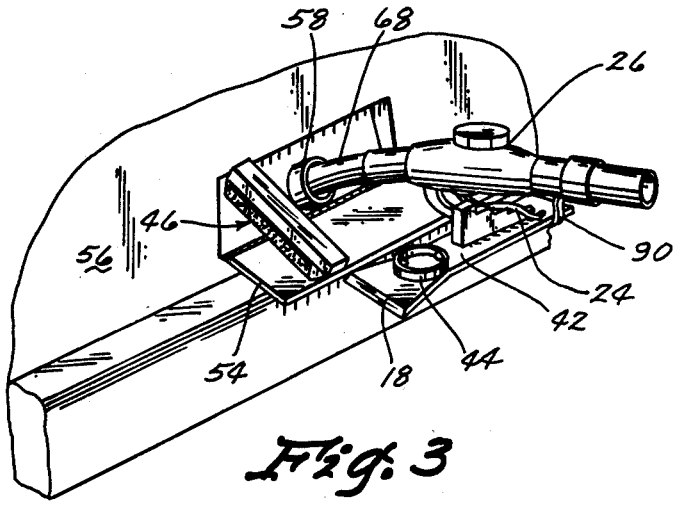
FIG. 3 is a perspective view of the present invention being utilized with a gasoline pump handle.

A plate element 20 is securely attached to the upper surface 22 of rear portion 14 as shown in FIG. 1. Plate element 20 is a jam means to hold the operating lever 24 of a conventional gas pump handle 26 in a selected activating position as illustrated in FIG. 3. The top portion of plate element 20 has a plurality of surfaces 28, 30, 32, 34, 36 and 38 vertically stepped above support element 12. Stepped surface 38 is a safety step element while the remaining stepped surfaces 28, 30, 32, 34 and 36 are intended to individually, selectively engage and maintain lever 24 in an operating condition when the tool device 10 is inserted between lever 24 and guide 40 of pump handle 26 as shown in FIG. 3 with safety step 38 preventing tool device 10 from sliding through guide 40. The preferable vertical distances between lower surface 22 of rear portion 14 and the respective stepped surfaces are as follows: $1\frac{3}{4}$ inches for stepped surface 28, 2 3/16 inches for stepped surface 30, $2\frac{3}{8}$ inches for stepped surface 32, $2\frac{5}{8}$ inches for stepped surface 34, 2 15/16 inches for stepped surface 36, and $3\frac{3}{8}$ inches for safety stop 38. These distances have been found to be preferable for conventional gas pump handles and provide a selective range of flow rates as determined by the respective position of the operating lever.

A supporting surface 42 is provided adjacent the forward edge 43 of plate element 20 in order to support a gas cap during the filling operation. By utilizing surface 42 to support a gas cap 44 during filling, one is less likely to forget to return the gas cap to the filler pipe when the pumping operation is completed.

A license plate jam element 46 is detachably secured to the side 48 of plate element 20 by means of pressure adhesive elements 50 and 52. Pressures adhesives are conventional and allow for quick and easy detachment and securement of jam element 46 to plate element 20. Jam element 46 is utilized to maintain a spring biased license plate 54 in a position away from automobile body 56 to allow unhampered access to filler pipe 58 as shown in FIG. 3. Jam element 46 is length adjustable to accommodate various body styles and is comprised of upper bar 60 and lower bar 62 joined together by bolts 64 extending through apertures 66 and threadably engaging a nut 67 at the end thereof. By disengaging the nuts and bolts, the apertures 66 in bars 60 and 62 may be realigned to extend the overall length of jam element 46 from that shown in FIG. 1. The bolts are then reinserted through the aligned apertures and the bar elements are securely joined together by tightening the nuts.

In operation, the license plate jam element 46 is removed from the side surface 48 of plate element 20 and inserted between the license plate 54 and automobile body 56 (FIG. 3). This holds the license plate away from the automobile body to provide easy access to filler pipe 58. Upon insertion of nozzle 68 into filler pipe 58, the desired position of operating lever 24 is chosen and tool device 10 is inserted between guide 40 and lever 24 so that one of the stepped surface will maintain lever 24 in the desired position (FIG. 3). The spring biasing of lever 24 will contribute to tool 10 being "jammed" in position between lever 24 and guide 40 to allow the pumping operation to continue unattended by the customer. The customer is thus not required to stay out in inclement weather or is free to attend to other maintenance matters during the pumping operation. When the gas tank is filled to capacity, a shut-off valve in the conventional gas pump handle 26 will usually shut off the gas flow to prevent overflow. Since the gas cap is supported right on the tool device, the customer is reminded to replace it after the pumping operation is completed.

In addition to providing a means for automatic pumping at a self-service station, tool device 10 can be utilized as a windshield ice scraper with rear portion 14 serving as a handle and beveled forward edge 18 providing the necessary shape for removing ice from a windshield.

Thus, it can be seen that this device accomplishes at least all of its stated objectives.

What is claimed is:

1. An automobile tool device comprising, an elongated support element having forward and rearward ends, said forward end having a beveled edge adapted for removing ice from a windshield, and a jam means to hold the operating lever of a gasoline pump handle in an operating condition, said jam means being associated with said support element and comprising a member having an upper edge of a plurality of stepped surfaces, each of said surfaces adapted to engage the operating lever of a gasoline pump handle.

2. The device of claim 1 wherein said upper edge has at least six stepped surfaces, said surfaces being vertically spaced apart from the lower surface of said support member the respective distances of $1\frac{3}{4}$ inches, 2 3/16 inches, $2\frac{3}{8}$ inches, $2\frac{5}{8}$ inches, 2 15/16 inches, and $3\frac{3}{8}$ inches.

3. The device of claim 1 wherein said elongated support element comprises means to support an automobile gas cap.

4. The device of claim 1 wherein a second jam means is detachably secured to said support element and said first mentioned jam means, said second jam means adapted to hold a spring biased license plate in a position away from the body of an automobile.

5. The device of claim 4 wherein said second jam means is length adjustable.

6. The device of claim 5 wherein said second jam means comprises first and second bar elements with each said bar element having a plurality of apertures therethrough and nut and bolt means securing said first bar element to said second bar element.

* * * * *